US006834584B1

(12) United States Patent
MacNeil

(10) Patent No.: US 6,834,584 B1
(45) Date of Patent: Dec. 28, 2004

(54) POCKET HAND STAMP

(75) Inventor: Anthony D. MacNeil, Piscataway, NJ (US)

(73) Assignee: M&R Marking Systems, Inc., Piscataway, NJ (US)

( * ) Notice: Subject to any disclaimer, the term of this patent is extended or adjusted under 35 U.S.C. 154(b) by 0 days.

(21) Appl. No.: 10/654,359

(22) Filed: Sep. 3, 2003

(51) Int. Cl.[7] ..... B41K 1/42; B41J 27/00; B41F 31/00

(52) U.S. Cl. ..... 101/333; 101/103; 101/104; 101/105; 101/106; 101/327; 101/334; 101/359

(58) Field of Search ..... 101/333, 334, 101/104, 327, 359, 103, 105, 106

(56) References Cited

U.S. PATENT DOCUMENTS

| | | | | | |
|---|---|---|---|---|---|
| 4,289,070 | A | | 9/1981 | MacGregor | |
| 4,852,489 | A | | 8/1989 | Wall et al. | |
| 5,105,738 | A | * | 4/1992 | Mehaffey | 101/333 |
| 5,377,599 | A | | 1/1995 | Wall et al. | |
| 5,517,916 | A | | 5/1996 | Dour et al. | |
| 5,611,984 | A | | 3/1997 | Sculler et al. | |
| 5,623,875 | A | * | 4/1997 | Perets | 101/334 |
| 5,649,485 | A | | 7/1997 | Dour et al. | |
| 5,740,737 | A | * | 4/1998 | Polak et al. | 101/334 |
| 5,768,992 | A | | 6/1998 | Daw et al. | |
| 6,007,751 | A | | 12/1999 | Sculler et al. | |
| 6,119,596 | A | | 9/2000 | Fletcher et al. | |
| 6,290,419 | B1 | * | 9/2001 | Hirschmann | 401/195 |
| 6,348,168 | B1 | | 2/2002 | Lowrance et al. | |
| 6,453,813 | B1 | * | 9/2002 | Faber | 101/405 |
| 6,499,398 | B2 | | 12/2002 | MacNeil | |
| 6,500,601 | B1 | | 12/2002 | Sculler et al. | |
| D478,930 | S | | 8/2003 | Zambelli et al. | |
| 6,679,168 | B1 | * | 1/2004 | Shih | 101/333 |

* cited by examiner

*Primary Examiner*—Andrew H. Hirshfeld
*Assistant Examiner*—Marvin Crenshaw
(74) *Attorney, Agent, or Firm*—Lerner, David, Littenberg, Krumholz & Mentlik, LLP

(57) ABSTRACT

A compact hand stamp is disclosed. The hand stamp may include a platen and corresponding marking structure that can be moved between a rest position, where a design on the marking structure is remote from a surface to be imprinted and is arranged at an angle of about 90 degrees with respect to the surface, and a printing position where the design of the marking structure is in contact with the surface to be imprinted. The hand stamp may also include a platen having reinking ports and a cover mounted for slidable movement over the reinking ports.

19 Claims, 7 Drawing Sheets

POCKET HAND STAMP

FIELD OF THE INVENTION

The present invention pertains to hand stamps. More particularly, the present invention pertains to hand stamps that are compact and include microporous marking structures.

BACKGROUND OF THE INVENTION

Microporous marking structures for use with hand stamps are typically made of a polymeric material, or other open cell compositions, such as specially formulated foam, and resin, such as thermoplastic resin, which combine to form a slab-like structure including a large quantity of microscopic pores. The microporous structure may be impregnated with ink or other suitable marking fluid, which fill many of the microscopic pores.

Hand stamps having microporous marking structures are commercially known as pre-inked hand stamps as they can be used to create numerous impressions without requiring a user to introduce additional ink into the marking structure. This is possible due to the microscopic size of the pores, which allow the ink initially retained therein to escape at a controlled rate.

One brand of high quality pre-inked hand stamps is manufactured and sold by M&R Marking Systems, Inc. of Piscataway, N.J. under the trademark ROYAL MARK. These pre-inked marking structures are made from ROYAL MARK brand gel which comprises a mixture of thermoplastic resin and ink. This mixture is also known as pre-mix used for manufacturing microporous marking structures.

Various methods of manufacturing such microporous marking structures exist. When microporous structures for use with currently available ROYAL MARK pre-inked hand stamps are manufactured, the pre-mix, which includes a desired quantity of ink, is poured into a mold. The mold is then heated in a vulcanizer at a predetermined pressure and temperature for a selected period of time. When this procedure is completed, the marking structure has the form of a microporous slab and may be removed from the mold. Typically, excess ink is then removed from the marking structure by a process known as stabilizing.

Another known method of manufacturing microporous marking structures contemplates initially forming a microporous structure without ink. Such microporous structures may be manufactured by sintering, salt-leaching or other methods. M&R Marking Systems also manufactures and sells this type of marking structures and associated hand stamps under the trademark OPTIMARK. This type of microporous structure is then impregnated with ink during a separate procedure which may require immersing of the microporous marking structure in an ink pool, subjecting the microporous marking structure and ink to a vacuum environment or other known methods. With this type of marking structure, it is also usually required to stabilize the structure (i.e., remove excess ink therefrom) prior to assembly on a hand stamp mount.

Regardless of whether the microporous marking structures have been manufactured from gel material, where ink is initially impregnated therein during the manufacturing process, or whether they are initially formed without ink, such microporous marking structures are secured to a platen of a hand stamp.

Hand stamps are typically operable between a rest position, where the marking structure is remote from a surface to be imprinted and a printing position, where the marking structure is in contact with a surface to be imprinted. Movement of the marking structure occurs upon depression of a handle or a case by a user of the hand stamp.

Because pre-inked hand stamps do not need a separate ink pad as a source of ink, the printing face of the marking structure is typically arranged parallel to the plane of a surface to be imprinted at all times. Thus, when the marking structure is in a rest position, it is spaced from and extends coplanar with the surface to be imprinted. As the printing surface of the marking structure is moved into its printing position, it continues to face the surface to be imprinted through contact with such surface.

High quality self-inking hand stamps are also sold by M&R Marking Systems, Inc. One well-known brand is marketed under the trademark IDEAL®. Examples of IDEALS brand self-inking hand stamps are described in U.S. Pat. Nos. 5,649,485, 4,852,489 and 4,432,281.

The marking structures in self-inking hand stamps are typically made of rubber or the like and must be placed in contact with a source of ink, such as an internal ink pad, when the hand stamp is in a rest position. The ink pad may be permanently arranged within the hand stamp or may be removable therefrom, such as the ink pad disclosed in the '485 patent.

Rubber marking structures used in self-inking hand stamps have a printing surface, which is typically arranged to face 180 degrees away from the surface to be imprinted when the hand stamp is in a rest position. When the hand stamp is depressed into a printing position, the marking structure may be moved along with a platen on which it is mounted through 180 degrees until it contacts the surface.

Thus, the movement of the marking structure in a pre-inked hand stamp is different from the movement of prior art marking structures in self-inking hand stamps. Pre-inked and self-inking hand stamps typically include a frame that is sized and shaped to accommodate a pre-inked marking structure that can easily move between rest and printing positions. The frame of prior art hand stamps must be large enough to enclose the width of associated marking structures. This is a shortcoming of prior art hand stamps as they are often larger than desired by the user.

Prior art hand stamps sometimes include one or more reinking ports. For example, reinking ports have been arranged on the platen of pre-inked hand stamps to permit a user to selectively apply ink or other marking fluid to the rear surface of a microporous marking structure secured to the platen. Reinking ports have also been used in prior art self-inking hand stamps on the rear surface of an inkwell so that a user can apply ink, or other marking fluid, to an associated ink pad.

However, one drawback of prior art hand stamps including reinking ports is that the reinking ports expose the ink-impregnated marking structure or ink pad to air and contaminants, thus contributing to contamination or premature drying out of the ink retained therein.

SUMMARY OF THE INVENTION

The present invention addresses the aforementioned shortcomings associated with prior art hand stamps. In one embodiment, a hand stamp comprises a compact hand stamp. The hand stamp may comprise a frame and a case arranged for slidable movement on the frame. A platen may be connected to the case and is movable therewith. A marking structure may be mounted on the platen. The marking structure may include a rear surface adjacent the platen and a front surface including a design thereon. The marking structure is movable with the platen between a rest position where the design is remote from a surface to be imprinted and a printing position where the design is in contact with the surface to be imprinted. Preferably, the marking structure is arranged at an angle of about 90 degrees with respect to the surface to be imprinted when it is in a rest position.

In a preferred embodiment, the marking structure may comprise a microporous material. Marking fluid may be impregnated into the microporous material. Thus, in a preferred embodiment, the hand stamp comprises a pre-inked hand stamp. In alternate embodiments, the hand stamp may comprise a self-inking hand stamp.

Preferably, the platen comprises a front surface, which faces the rear surface of the marking structure and a rear surface, which faces away from the marking structure. At least one reinking port preferably extends through the front and rear surfaces of the platen to permit marking fluid to be applied to the rear surface of the marking structure and to thus be absorbed therein.

In another preferred embodiment, the at least one reinking port may comprise a plurality of reinking ports. In a particular preferred embodiment, the plurality of reinking ports may comprise two reinking ports.

The hand stamp may also comprise a cover member arranged on the rear surface of the platen. The cover member is preferably movable between a sealed position where it is arranged adjacent to the at least one reinking port and an open position where it is at least partially remote from the at least one reinking port whereby marking fluid can be applied to the rear surface of the marking structure. It is also preferable for the cover to be mounted for slidable movement on the rear surface of the platen. Thus, the cover may be secured on the platen in close proximity to the marking structure.

The hand stamp may also comprise at least one spring arranged between the case and the frame. The at least one spring is operative to bias the case away from the frame, such that the marking structure is remote from the surface to be imprinted when in its rest position.

The hand stamp may also comprise restricting means for restricting movement of the platen and the marking structure thereon through a range of about 90 degrees between the rest position and the printing position. The restricting means may comprise cooperating features of the frame and the case. The platen may further comprise a frame arranged on the rear surface thereof adjacent to the at least one reinking port. In this preferred embodiment, the cover member is preferably arranged within the platen frame when in its sealed position.

In another preferred embodiment, the cover member may comprise a plurality of panels mounted on the rear surface of the platen and is movable between a sealed position where the plurality of panels are arranged adjacent to corresponding ones of the plurality of reinking ports and an open position where the plurality of panels are at least partially remote from the plurality of reinking ports whereby marking fluid can be applied to the rear surface of the marking structure.

Various advantages are obtained by using the hand stamp of the present invention. For example, it may be compact due to the structure and arrangement of the platen, the case and the frame. Further, the structure and arrangement of the cover member on the platen may serve to prolong the life of the associated marking structure and may protect it against contaminants such as dust or the like. The arrangement of the cover member also contributes to the compact nature of the present hand stamp.

Additional advantages and features of the present invention will be more fully understood in view of the following detailed description of the preferred embodiments and corresponding drawings.

DETAILED DESCRIPTION

A preferred embodiment of the present hand stamp 10 and its components is shown in FIGS. 1–10. The hand stamp 10 includes a case 12 which is adapted to be held in a user's hand and depressed to operate the hand stamp between a rest position (shown in FIG. 1) and a printing position (shown in FIG. 4) as described further herein.

Figure 1:
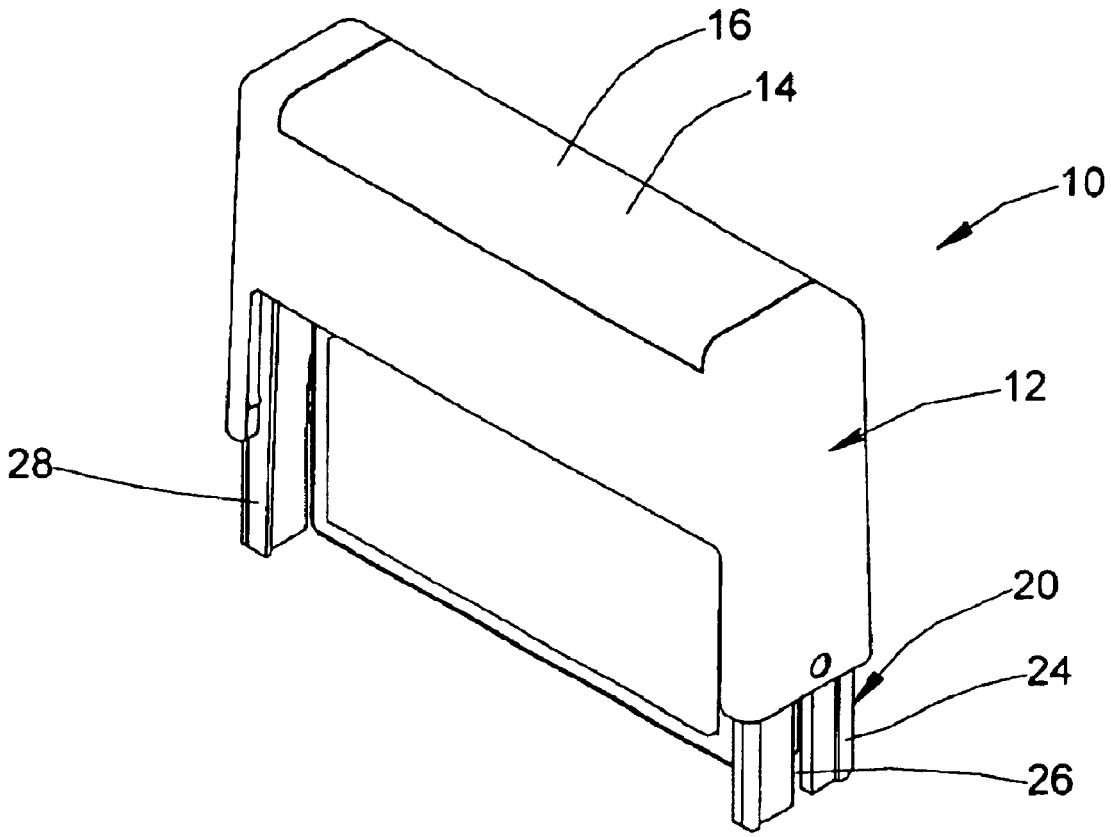
FIG. 1 is a perspective view of an assembled hand stamp of the present invention in a rest position.
Figure 2:
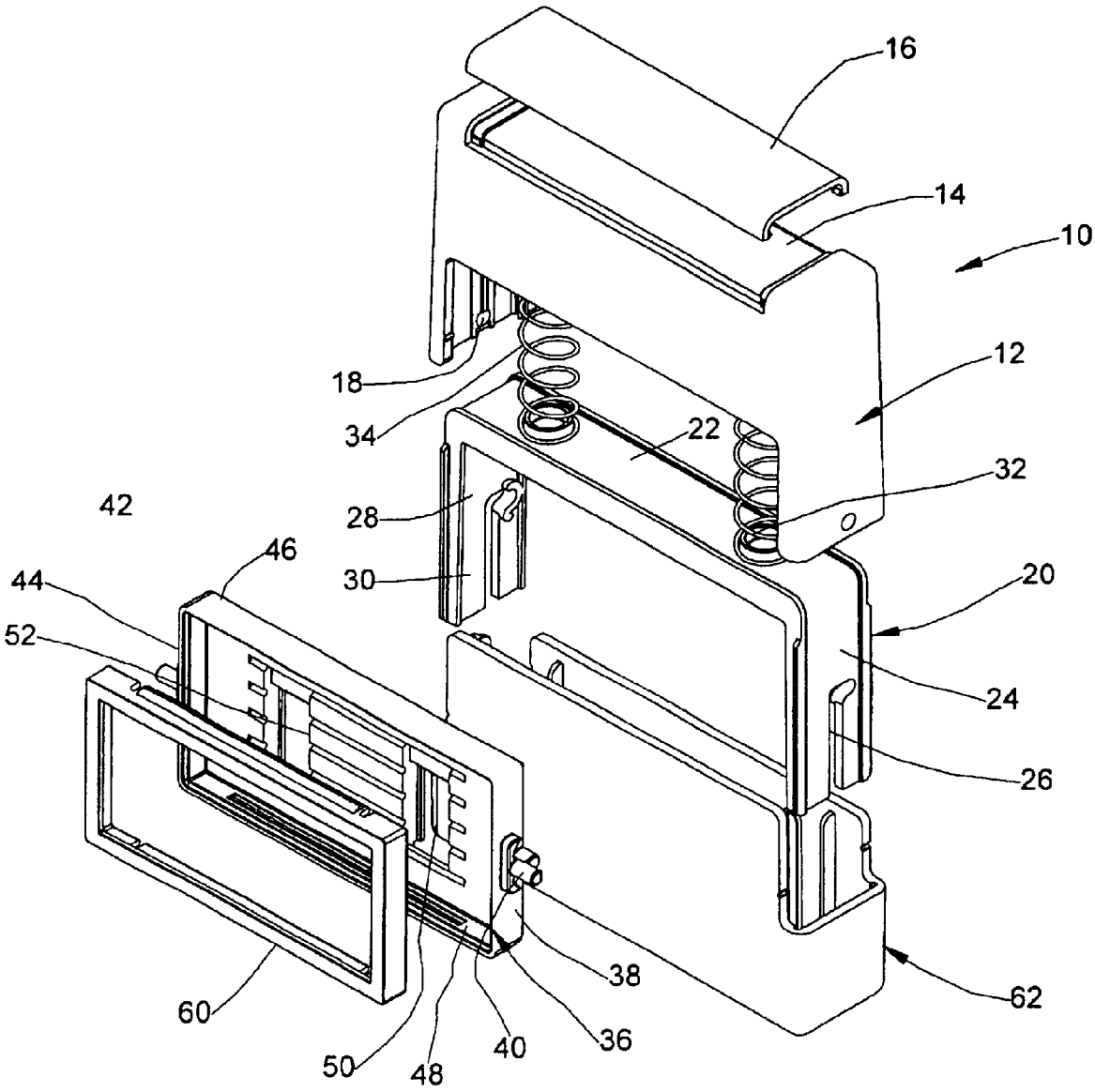
FIG. 2 is an exploded view of the hand stamp of FIG. 1, excluding the marking structure.
Figure 4:
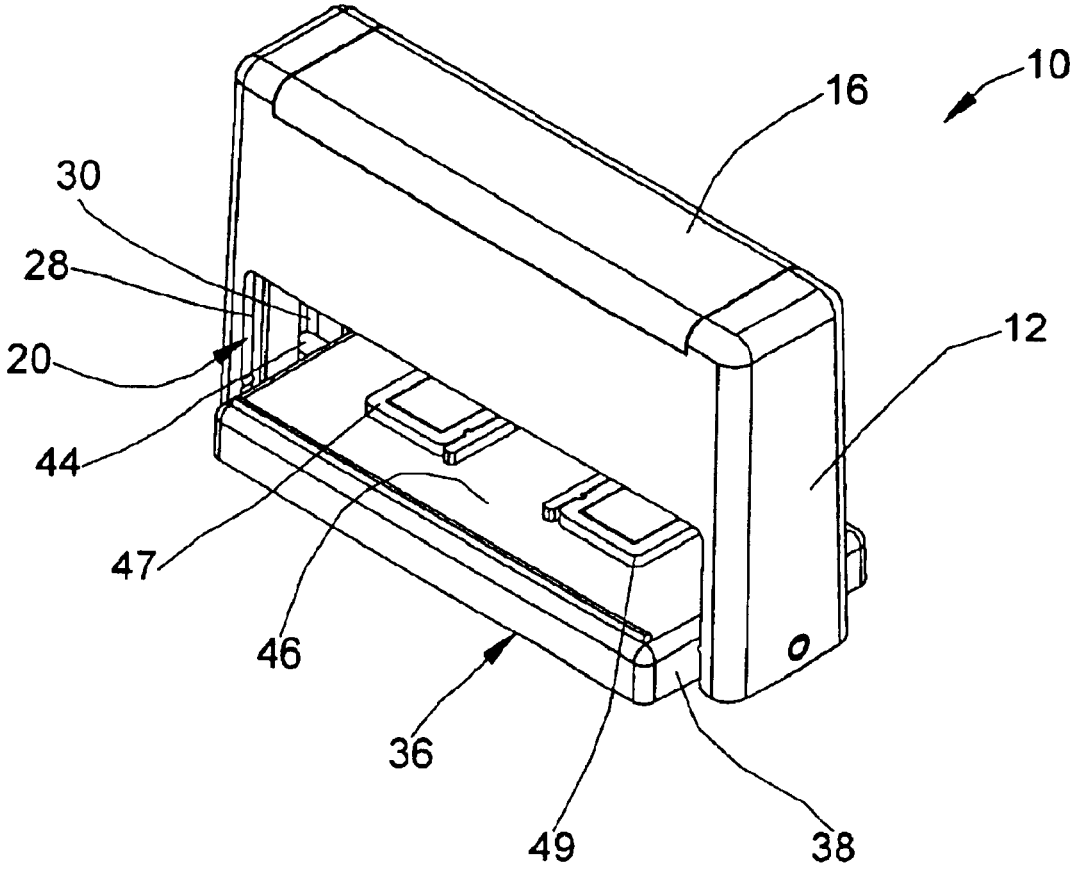
FIG. 4 is a perspective view of the present hand stamp when in a printing position.

In the preferred embodiment shown in FIGS. 1, 2 and 4, the case 12 may include an inlaid message area 14 in which the message to be imprinted by the and stamp may be displayed. Alternatively, other information may be arranged within inlaid message area 14. A transparent message cover 16 is arranged over the inlaid area 14. The substantially transparent nature of cover 16 will permit a user to easily read the message retained in inlaid area 14.

As shown in FIG. 2, a pair of apertures 18 are arranged in opposing sides of the case 12 for receiving corresponding pins of a platen 36 as described further below. The right side aperture is not shown in FIG. 2, but is identical to the aperture 18 arranged on the inner wall of the left side of the case 12. In alternate embodiments, the apertures 18 may extend entirely through the walls of case 12.

The case 12 is arranged on frame 20 as shown in FIGS. 1–4. The top of frame 20 includes a planar surface 22. The frame 20 includes right and left sides 24 which extend downwardly from opposing sides of the planar top 22. The right side 24 of frame 20 includes a groove 26 extending along the length thereof. Similarly, the left side 28 includes a groove 30 extending along the length thereof. Thus, in the preferred embodiment, right and left sides 24 and 28 are mirror images of each other.

Figure 3:
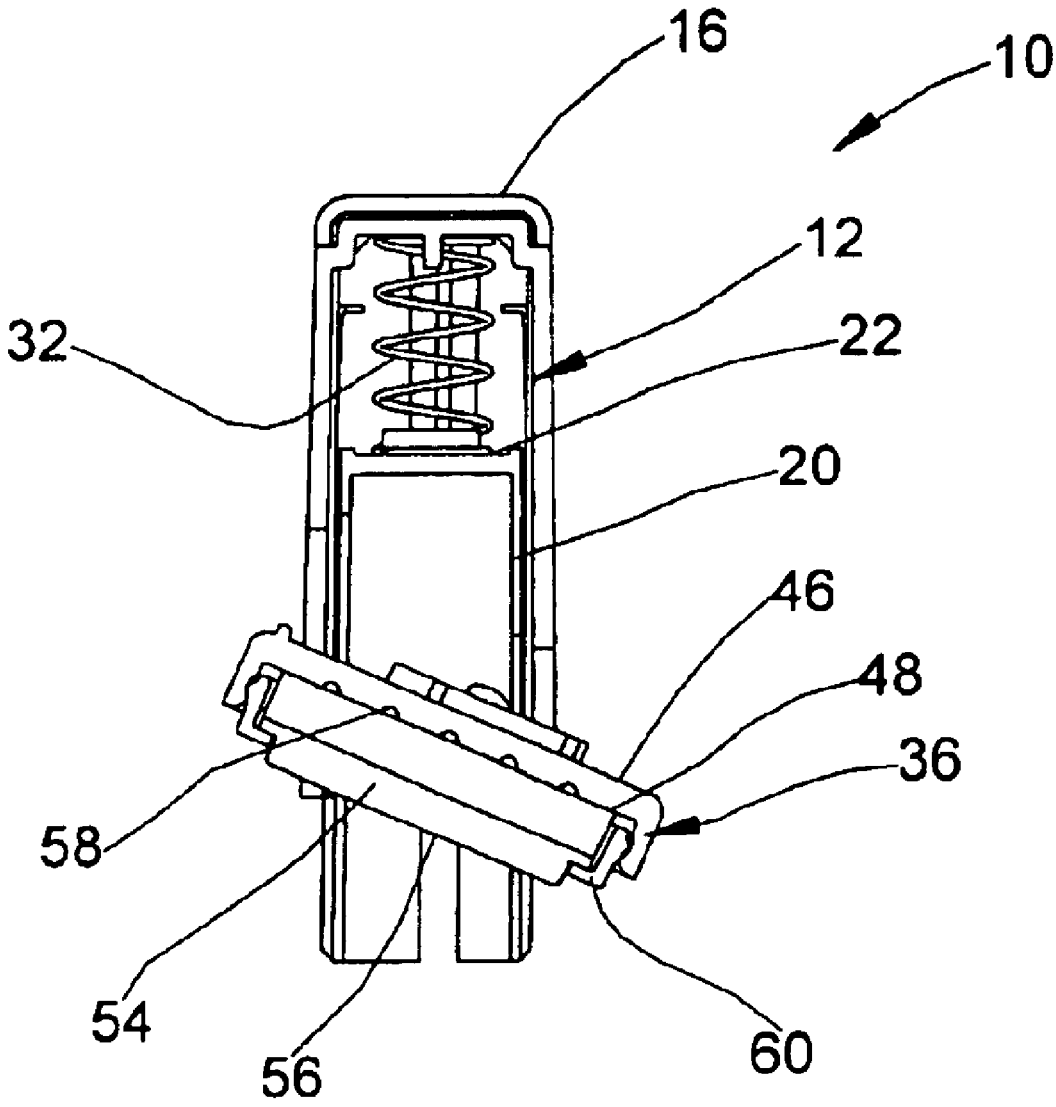
FIG. 3 is a partial cross-sectional view taken along line III—III of FIG. 1 showing use of the present hand stamp in transition between its rest and printing positions.

A pair of springs 32 and 34 are arranged on the top of the frame 22 and, as shown in FIGS. 2 and 3, extend between the top of the frame 22 and the case 12. The springs 32 and 34 cooperate with the frame 20 and case 12 to bias the hand stamp into its rest position where the associated marking structure is remote from a surface to be imprinted.

A platen 36 is shown in FIGS. 2 and 5–10 as having a generally rectangular shape. It is defined by right side 38 and opposing left side 42. A post 40 extends from the right side of the platen while a corresponding post 44 extends from the left side thereof. The platen 36 includes a top surface 46 and an opposing bottom surface 48. A pair of reinking ports 50 and 52 are arranged on the platen and extend between the top and bottom surfaces 46 and 48 as shown in FIGS. 2 and 4–10.

Figure 5:
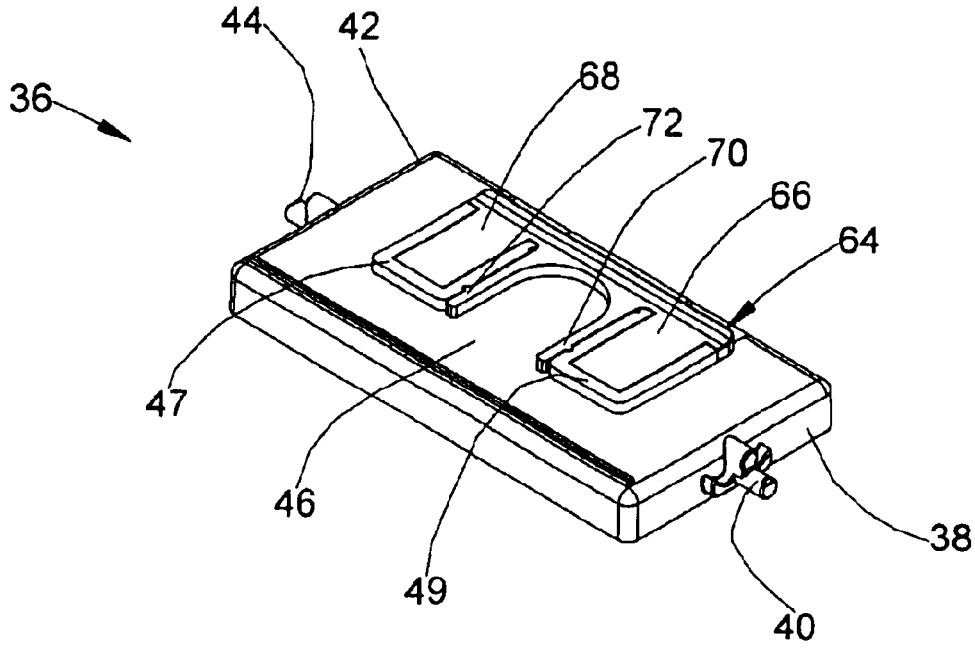
FIG. 5 is a perspective top plan view of the platen of the present hand stamp shown with its cover in a sealed position.
Figure 7:
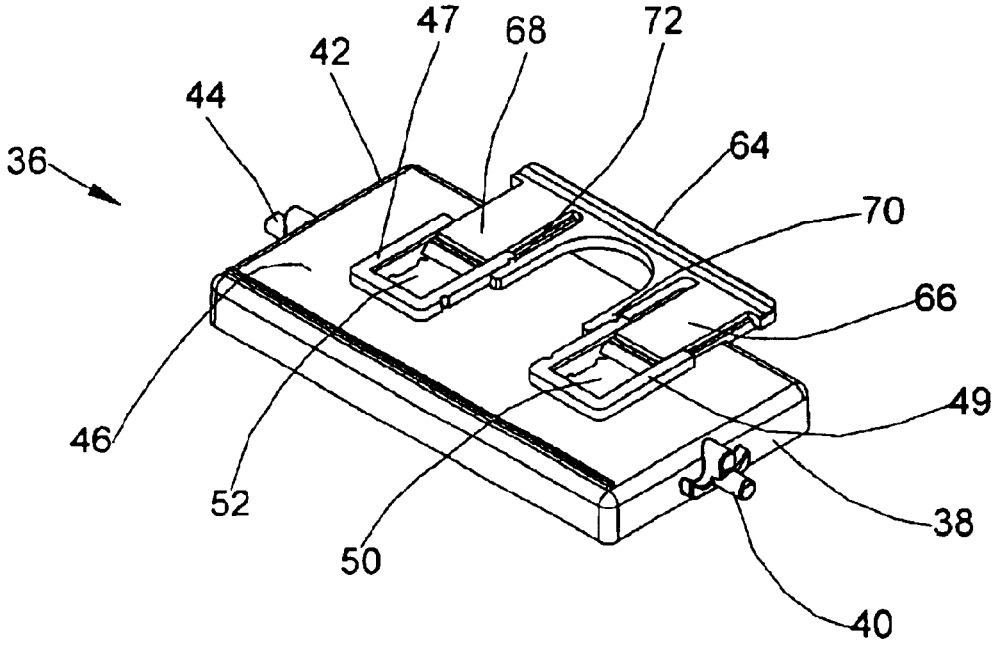
FIG. 7 is a perspective top plan view of the platen of the present hand stamp shown with its cover partially removed to permit access to reinking ports.

In a preferred embodiment, the platen 36 includes frame members 47 and 49 arranged on the top surface 46 thereof. The frame members may be integrally molded with the top surface 46 of the platen 36 or may be separately formed and secured thereon. The frame members 47 and 49 surround several sides of the right and left reinking ports 50 and 52, respectively as shown in FIGS. 5 and 7.

When in assembled position, the posts 40 and 44 of platen 36 are arranged within corresponding apertures 18 of the case 12.

The hand stamp marking structure 54 is shown in cross-sectional view in FIG. 3. When assembled, marking structure 54 is arranged within platen 36 adjacent to bottom surface 48. The marking structure includes a rear surface 58, which is preferably arranged adjacent to the bottom surface 48 of the platen 36. The marking structure 54 also includes a front surface 56 having a design thereon, which is adapted to imprint an ink design onto a desired surface.

The marking structure 54 preferably comprises a microporous marking structure such as those sold by M&R Marking Systems, Inc. for use in hand stamps under the brand names ROYAL MARK® or OPTIMARK®. Thus, marking structure 54 retains marking fluid, such as ink, therein and will controllably release a sufficient amount of ink when the front surface 56 including the design thereon is urged into contact with a surface to be imprinted. Many imprints may be obtained before it is necessary to reintroduce ink, or other marking fluid, through the rear surface 58 of the marking structure 54 as discussed below.

A retaining clip 60 is shown in FIGS. 2 and 3. The retaining clip 60 is sized and shaped to secure the marking structure 54 in assembled position adjacent to the bottom surface 48 of platen 36. In an alternate embodiment, it may not be necessary to include retaining clip 60 as part of the hand stamp design, as the marking structure 54 may be secured by adhesive to the platen 36. An example of one acceptable adhesive arrangement is disclosed in U.S. Pat. No. 6,119,596.

A cover member 64 is shown in FIGS. 5–10 and is intended to be arranged on the platen 36. The cover member 64 includes a right side panel member 66 and left side panel member 68. It also includes a right side spring arm 70 and a left side spring arm 72.

Figure 6:
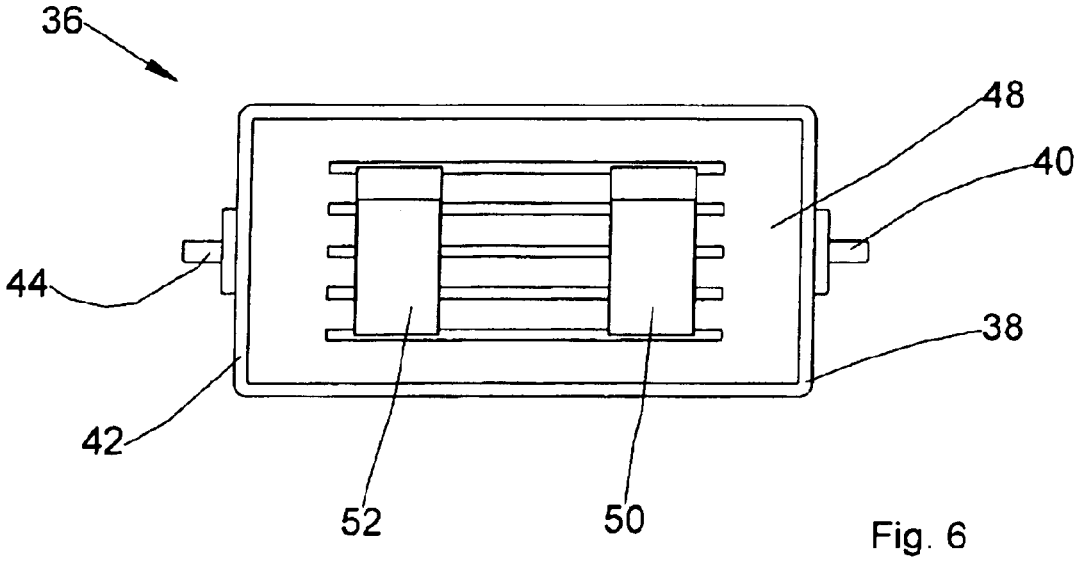
FIG. 6 is a bottom plan view of the platen shown in FIG. 5 with no marking structure thereon.

In the preferred embodiment shown in FIGS. 1–10, the cover member 64 is normally arranged in a sealed position (i.e., closed position) where marking fluid cannot be placed through reinking ports 50 and 52. This arrangement is shown in FIGS. 5 and 6.

When it is desired to add additional marking fluid to marking structure 54, the cover member 64 may be entirely removed, or partially removed, from its closed position, so that marking fluid can be introduced through reinking ports 50 and 52 such that the ink supply of marking structure 54 is sufficiently replenished. The cover member 64 is shown in a partially removed position in FIGS. 7 and 8. It is shown in a fully removed position in FIGS. 9 and 10.

The hand stamp 10 may also include an outer cover 62, which functions as a dust cover. The outer cover 62 is shown in FIG. 2.

The purpose of outer cover 62 is to facilitate storage of the hand stamp 10 in such a manner so that it will not be accidentally depressed where ink is placed in contact with objects other than the desired surface to be imprinted. In addition, dust cover 62 extends the life of marking structures 54 by preventing it from drying out when the hand stamp 10 is arranged in a stored position.

One advantage of hand stamp 10 over prior art pre-inked hand stamps is that it is particularly compact and efficient. When the hand stamp 10 is arranged in its rest position, it appears as shown in FIG. 1. In such rest position, the front surface 56 including the design of the marking structure 54 extends along a plane at an angle of about 90 degrees with respect to the surface to be imprinted. When a user desires to imprint a design on a surface, he may depress the case 12 downwardly against the bias of the springs 32 and 34. This will cause the platen 36 and associated marking structure 54 to begin to move downwardly and rotate toward the surface to be imprinted as shown in the intermediate operating position of FIG. 3. As the user continues to depress the case 12 downwardly toward the top surface 22 of frame 20, the platen 36 and corresponding marking structure 54 continue to move downwardly until the front surface 56 of the marking structure contacts the desired surface to be imprinted as illustrated in FIG. 4. At this time, the front surface 56 of marking structure 54 traveled a total of about 90 degrees from its rest position to its printing position.

Advantages are also obtained through use of the novel cover member 64 as illustrated in FIGS. 5–10. The slidable arrangement between the cover member 64 and the left and right side frames 47 and 49 arranged adjacent the left and right side reinking ports 50 and 52 permit the cover member 64 to be placed in close proximity to the rear surface of the marking structure 58. Thus, cover member 64 works in conjunction with dust cover 62 in prolonging the life span of the marking structure 54 before it must be subjected to reinking. Cover member 64 also serves to prevent contaminants, such as dust, from settling on the marking structure.

FIG. 6 illustrates an isolated view of the bottom surface of the platen 36 when the cover member 64 is arranged such that its right and left side panel members 66 and 68 are within corresponding left and right frame members 47 and 49. In this position, the right side spring arm 70 and the left side spring arm 72 secure the cover member 64 in assembled position.

Figure 8:
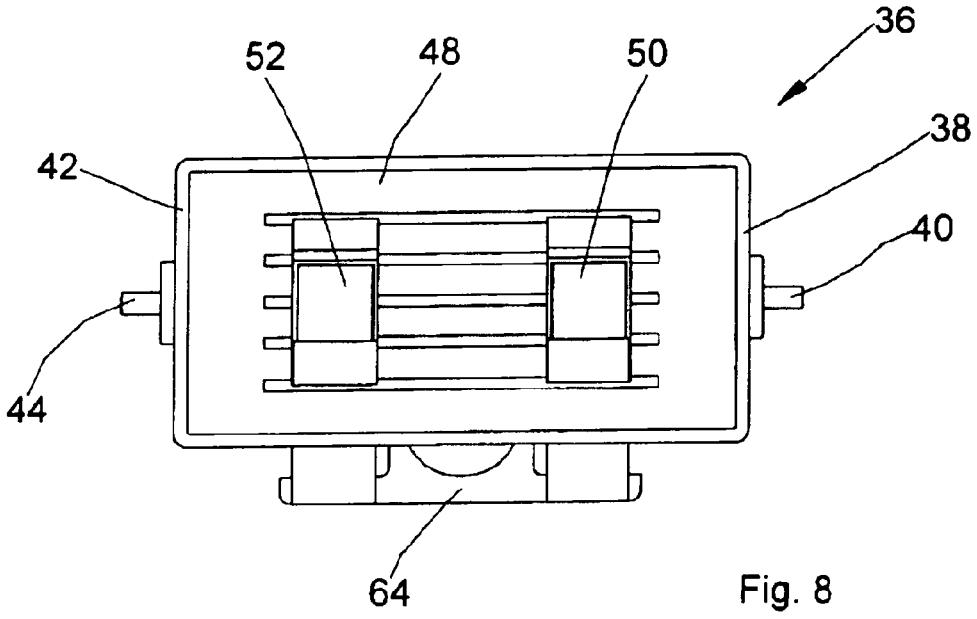
FIG. 8 is a bottom plan view of the platen shown in FIG. 7 excluding the marking structure.
Figure 9:
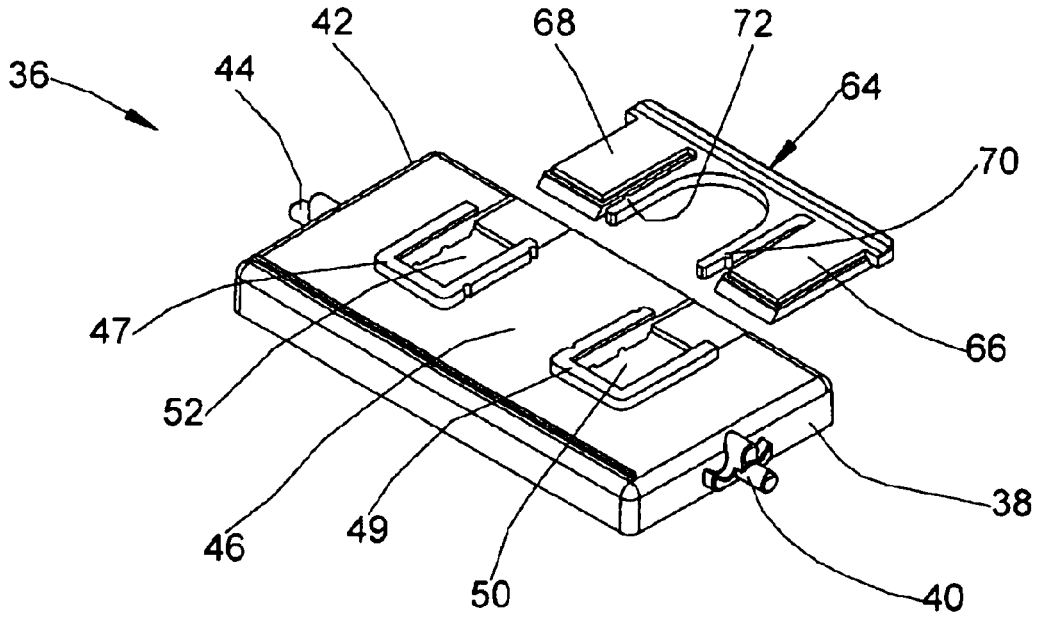
FIG. 9 is a perspective top plan view of the platen of the present hand stamp shown with its cover in a fully removed position again permitting access to reinking ports.
Figure 10:
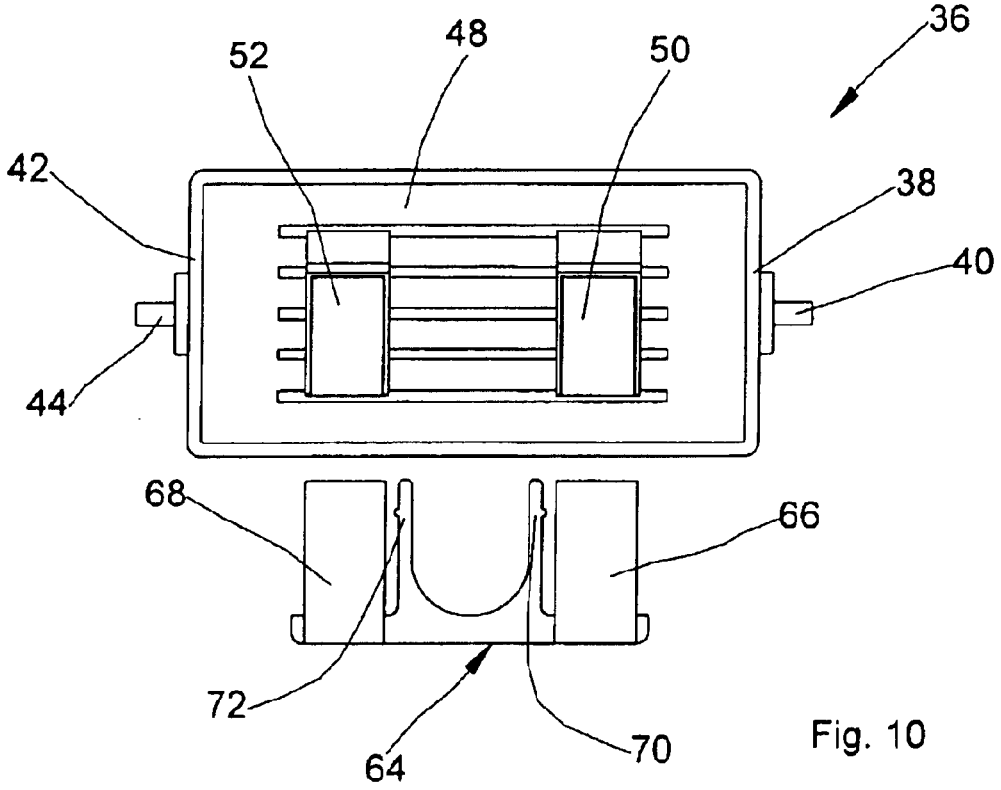
FIG. 10 is a bottom plan view of the platen shown in FIG. 9, excluding the marking structure.

When it is desirable to re-ink the marking structure 54, the user can simply slide the cover member 64 out of frame members 47 and 49. The cover member 64 need not be entirely removed from the frame members 47 and 49. Rather, the cover member 64 can be left in a partially removed position as shown in FIGS. 7 and 8. Alternatively, the cover member 64 can be entirely removed from the frame members 47 and 49 as shown in FIGS. 9 and 10.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A hand stamp comprising:

a frame;

a case arranged for slidable movement on said frame;

a platen connected to said case and being movable therewith; and a marking structure mounted on said platen, said marking structure having a rear surface adjacent said platen and a front surface including a design thereon, said platen including a front surface facing said rear surface of said marking structure, a rear surface facing away from said marking structure, and at least one reinking port extending through said front and rear surfaces to permit marking fluid to be applied to said rear surface of said marking structure, said marking structure being movable with said platen between a rest position wherein said design is remote from a surface to be imprinted and is arranged at an angle of about 90 degrees with respect to such surface and a printed position wherein said design is in contact with the surface to be imprinted.

2. The hand stamp of claim 1, wherein said marking structure comprises microporous material and marking fluid impregnated therein.

3. The hand stamp of claim 1, wherein said at least one reinking port comprises a plurality of reinking ports.

4. The hand stamp of claim 1, further comprising a cover member arranged on said rear surface of said platen, said cover member being movable between a sealed position where it is arranged adjacent said at least one reinking port and an open position where it is at least partially remote from said at least one reinking port whereby marking fluid can be applied to said rear surface of said marking structure.

5. The hand stamp of claim 4, wherein said cover is mounted for slidable movement on said rear surface of said platen.

6. The hand stamp of claim 1, further comprising restricting means for restricting movement of said platen and said marking structure thereon through a range of about 90 degrees between said rest position and said printing position.

7. The hand stamp of claim 6, wherein said restricting means comprises cooperating features of said frame and said case.

8. The hand stamp of claim 5, wherein said platen further comprises at least one frame arranged on said rear surface thereof adjacent said at least one reinking port, said cover member being arranged within said frame when in said sealed position.

9. The hand stamp of claim 1, further comprising at least one spring arranged between said case and said frame, said spring biasing said case away from said frame such that said marking structure is remote from said surface to be imprinted when in rest position.

10. A hand stamp comprising:

a frame;

a case arranged for slidable movement on said frame;

a platen connected to said case and being movable therewith; and a microporous marking structure having marking fluid therein, said microporous marking structure being mounted on said platen and having a rear surface adjacent said platen and a front surface including a design thereon, said platen comprising a front surface facing said rear surface of said microporous marking structure and a rear surface facing away from said microporous marking structure and a plurality of reinking ports extending through said front and rear surfaces thereof to permit marking fluid to be applied to said rear surface of said microporous marking structure, said microporous marking structure being movable along with said platen between a rest position wherein said design is remote from a surface to be imprinted and is arranged at an angle of about 90 degrees with respect to such surface and a printing position wherein said design is in contact with the surface to be imprinted; and a cover member including a plurality of panels mounted on said rear surface of said platen and being movable between a sealed position where said plurality of panels are arranged adjacent corresponding ones of said plurality of reinking ports and an open position wherein said plurality of panels are at least partially remote from said plurality of reinking ports whereby marking fluid can be applied to said rear surface of said microporous marking structure.

11. The hand stamp of claim 10, wherein said platen comprises a plurality of frames arranged on said rear surface thereof adjacent corresponding ones of said plurality of reinking ports, said plurality of panels being arranged within corresponding ones of said plurality of frames when in said sealed position.

12. The hand stamp of claim 11, wherein said plurality of panels are mounted for slidable movement on said rear surface of said platen.

13. The hand stamp of claim 12, wherein said platen further comprises at least one frame arranged on said rear surface of said platen adjacent said at least one reinking port, said cover member being arranged within said frame when in said sealed position.

14. The hand stamp of claim 10, wherein said cover member further comprises a plurality of spring arms arranged to secure said plurality of panels in said sealed position adjacent said corresponding plurality of reinking ports.

15. A hand stamp comprising:

a frame;

a case arranged for slidable movement on said frame;

a platen connected to said case and being movable therewith; and a microporous marking structure having marking fluid therein, said microporous marking structure being mounted on said platen and having a rear surface adjacent said platen and a front surface including a design thereon, said platen comprising a front surface facing said rear surface of said microporous marking structure and a rear surface facing away from said microporous marking structure and at least one reinking port extending through said front and rear surfaces of said platen to permit marking fluid to be applied to said rear surface of said microporous marking structure, said microporous marking structure being movable along with said platen between a rest position wherein said design is remote from a surface to be imprinted and is arranged at an angle of about 90 degrees with respect to such surface and a printing position wherein said design is in contact with the surface to be imprinted; and a cover member mounted on said rear surface of said platen and being slidable between a sealed position where said cover member is adjacent said at least one reinking port and an open position wherein said cover member is at least partially remote from said at least one reinking port whereby marking fluid can be applied to said rear surface of said microporous marking structure.

16. The hand stamp of claim 15, further comprising at least one spring arranged between said case and said frame, said spring biasing said case away from said frame such that said marking structure is remote from said surface to be imprinted when in rest position.

17. The hand stamp of claim 16, further comprising restricting means for restricting movement of said platen and said marking structure thereon through a range of about 90 degrees between said rest position and said printing position.

18. The hand stamp of claim 17, wherein said restricting means comprises cooperating features of said frame and said case.

19. The hand stamp of claim 18, wherein said platen further comprises at least one frame arranged on said rear surface thereof adjacent said at least one reinking port, said cover member being arranged within said frame when in said sealed position.

* * * * *